US007210962B2

(12) United States Patent
Kameyama et al.

(10) Patent No.: US 7,210,962 B2
(45) Date of Patent: May 1, 2007

(54) WATERPROOF CONNECTOR

(75) Inventors: Isao Kameyama, Haibara-gun (JP); Takashi Toi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/125,144

(22) Filed: May 10, 2005

(65) Prior Publication Data

US 2005/0255748 A1 Nov. 17, 2005

(30) Foreign Application Priority Data

May 13, 2004 (JP) ..... P.2004-144045

(51) Int. Cl.
*H01R 13/40* (2006.01)

(52) U.S. Cl. ..... 439/589

(58) Field of Classification Search ..... 439/598, 439/587, 271, 272, 589
See application file for complete search history.

(56) References Cited

U.S. PATENT DOCUMENTS

| | | | | |
|---|---|---|---|---|
| 4,713,021 A * | 12/1987 | Kobler | 439/272 |
| 5,409,405 A | 4/1995 | Bungo | |
| 5,627,343 A * | 5/1997 | Brandolf | 174/153 R |
| 5,700,161 A | 12/1997 | Plummer et al. | |
| 6,030,252 A | 2/2000 | Oda et al. | |
| 6,193,549 B1 * | 2/2001 | Suzuki et al. | 439/589 |
| 6,375,500 B1 * | 4/2002 | Murakami et al. | 439/587 |
| 6,517,368 B2 * | 2/2003 | Hara et al. | 439/271 |
| 2002/0028603 A1 * | 3/2002 | Murakami et al. | 439/589 |
| 2003/0073354 A1 | 4/2003 | Hotea | |

FOREIGN PATENT DOCUMENTS

| | | | |
|---|---|---|---|
| EP | 0 851 536 A2 | | 7/1998 |
| JP | 61-179077 | * | 8/1986 |
| JP | 2002-134220 A | | 5/2002 |
| JP | 2002-231375 A | | 8/2002 |

* cited by examiner

*Primary Examiner*—Tulsidas C. Patel
*Assistant Examiner*—Vladimir Imas
(74) *Attorney, Agent, or Firm*—Sughrue Mion, PLLC

(57) ABSTRACT

A waterproof connector (100) receives female connection terminals (17) connected respectively to one ends of wires (21), and can be fitted to a mating connector (150) to be electrically connected thereto. The waterproof connector (100) includes an outer housing (11), an inner housing (13) which is provided within the outer housing (11), and holds the connection terminals (17) in such a manner that the inner housing is held in intimate contact with at least one of an outer peripheral surface of a wire press-fitting portion (17) of each connection terminal (17) and an outer peripheral surface of the associated wire (21), and a waterproof mechanism (15) which is made of a thermoplastic synthetic resin, and forms a liquid-tight seal between the wires (21), the outer housing (11) and the inner housing (13). The waterproof mechanism (15) is formed by the cured hot-melt adhesive.

2 Claims, 6 Drawing Sheets

WATERPROOF CONNECTOR

BACKGROUND OF THE INVENTION

1. Field of the Invention

This invention relates to a waterproof connector.

2. Related Art

First, the term "forward direction", used in the definition of a waterproof connector in this specification, means a direction of fitting of one connector to the other connector (In other words, a direction of connection of the one connector to the other connector), and the term "rearward direction" means a direction opposite to the connector fitting direction (that is, a connector disconnecting direction). Therefore, in the definition of the waterproof connector in this specification, the term "front" added to the beginning of each of terms for members, portions, regions, etc., means that these are disposed at the front side with respect to the fitting direction (that is, the connecting direction) of the waterproof connector, while the term "rear" added to the beginning of each of terms for members, portions, regions, etc., means that these are disposed at the rear side with respect to the fitting direction of the waterproof connector.

There is known one waterproof connector in which a waterproof mechanism is formed, using a thermoplastic synthetic resin (see, for example, Unexamined Japanese Patent Publication 2002-134220).

There is known another waterproof connector for electrical connection to a connector portion of an on-vehicle CCD (Charge Coupled Device) camera (see, for example, Unexamined Japanese Patent Publication 2002-231375).

In the formation of the waterproof mechanism of the waterproof connector by the use of the thermoplastic synthetic resin such as a hot-melt adhesive, care must be taken so that the thermoplastic synthetic resin will not flow to reach electrical contact portions of connection terminals of the waterproof connector. It is difficult to form the waterproof mechanism by the thermoplastic synthetic resin while taking this care.

Generally, in the formation of a waterproof mechanism of a waterproof connector by the use of a thermoplastic synthetic resin such as a hot-melt adhesive, wires (or a cable), extending from a rear side of an outer housing of the waterproof connector, are covered, together with the rear end portion of the outer housing, with the thermoplastic synthetic resin. A synthetic resin, forming the outer housing, does not always have a strong affinity for the thermoplastic synthetic resin such as a hot-melt adhesive. There is a possibility that when a stress acts on the wires after the molding, the portion of the molded outer casing, joined to the molded thermoplastic synthetic resin, is separated therefrom, so that a gap is formed in this joint portion, thus lowering the waterproof performance. Therefore, as a countermeasure for preventing the lowering of the waterproof performance, the waterproof mechanism is, in some cases, formed, using a large amount of thermoplastic synthetic resin.

However, the waterproof connector tends to become relatively large in size because of the provision of the waterproof mechanism, and when the waterproof connector is to be installed in some place, the waterproof connector is required to have a small (short) rearwardly-projecting length. For example, an on-vehicle CCD camera (hereinafter referred to merely as "CCD camera") is installed within a side mirror of a vehicle, and in addition to many parts including a mirror, a mechanism for adjusting the angle of this mirror and an electric motor for driving this mechanism, the CCD camera must be received within a limited internal space of the side mirror, and therefore a space, available at the rear side of the CCD camera for the installation of the waterproof connector therein is narrow. Therefore, the waterproof connector, having a large rearwardly-projecting length, can not be used for connection to the CCD camera.

SUMMARY OF THE INVENTION

This invention has been made in view of the above circumstances, and an object of the invention is to provide a waterproof connector having a structure by which in the formation of a waterproof mechanism by the use of a thermoplastic synthetic resin such as a hot-melt adhesive, the thermoplastic synthetic resin is prevented from flowing to reach electrical contact portions of connection terminals, and therefore a rearwardly-projecting length of the waterproof connector can be made small.

The above object has been achieved by a waterproof connector having features recited in the following Paragraphs.

A waterproof connector wherein the waterproof connector receives connection terminals connected respectively to one ends of wires, and can be fitted to a mating connector to be electrically connected thereto; and the waterproof connector comprises:

an outer housing;

an inner housing which is provided within the outer housing, and holds the connection terminals; and a waterproof mechanism which is made of a thermoplastic synthetic resin, and forms a liquid-tight seal between the wires, the outer housing and the inner housing; and the inner housing includes:

a body portion having contact portion insertion holes which respectively receive electrical contact portions of the connection terminals which can be electrically connected respectively to connection terminals of the mating connector; and a receiving portion having wire press-fitting portion receiving holes which respectively receive wire press-fitting portions of the connection terminals which are press-fastened respectively to the one ends of the wires; and the wire press-fitting portion receiving holes are formed in the receiving portion in such a manner that the receiving portion is held in intimate contact with at least one of an outer peripheral surface of the wire press-fitting portion of each connection terminal and an outer peripheral surface of the associated wire.

In the waterproof connector described above, the receiving portion includes:

a vertical wall which is formed on the body portion, and extends upwardly therefrom in a direction of extending of the contact portion insertion holes, part of each of the wire press-fitting portion receiving holes being formed in the vertical wall; and at least one opening/closing member in which other part of each of the wire press-fitting portion receiving holes is formed, the opening/closing member being engaged with the vertical wall to form the wire press-fitting portion receiving holes between the opening/closing member and the vertical wall; and at least one of the outer peripheral surface of the wire press-fitting portion of each connection terminal and the outer peripheral surface of the associated wire is held between the vertical wall and the opening/closing member.

In the waterproof connector described above, at least one of the wire press-fitting portion of each connection terminal and that portion of the associated wire, disposed adjacent to this wire press-fitting portion, is received in the corresponding wire press-fitting portion receiving hole, with the outer peripheral surface thereof held in intimate contact with the receiving portion. Therefore, the wire press-fitting portion of the connection terminal and/or the one end portion of the wire are disposed in the wire press-fitting portion receiving hole (formed in the inner housing) in closely-contacted relation to the inner peripheral surface of this hole. In this condition, the waterproof mechanism is formed, and therefore when the thermoplastic synthetic resin is supplied from the rear side of the connector so as to form a liquid-tight seal between the wires, the outer housing and the inner housing, the thermoplastic synthetic resin will not flow to reach the electrical contact portions of the connection terminals. Therefore, the thermoplastic synthetic resin can be supplied to all of the important portions within the waterproof connector, and therefore this construction can provide a sufficient strength to prevent the separation of the waterproof mechanism (the cured thermoplastic synthetic resin) even upon application of a stress on the wires. Therefore, the waterproof connector can be formed into a compact size, and particularly the rearwardly-projecting length of the outer housing can be reduced. Therefore, the waterproof connector of the invention is suitably used as a waterproof connector for connection, for example, to a CCD camera contained in a side mirror of a vehicle.

In the waterproof connector described above, after the electrical contact portion of each connection terminal is inserted into the contact portion insertion hole in the body portion of the inner housing, the opening/closing member of the receiving portion of the inner housing is engaged with the vertical wall, thereby forming the wire press-fitting portion receiving holes. At this time, at least one of the wire press-fitting portion of each connection terminal and that portion of the associated wire, disposed adjacent to this wire press-fitting portion, is received in the corresponding wire press-fitting portion receiving hole, with the outer peripheral surface thereof held between the vertical wall and the opening/closing member. Therefore, the wire press-fitting portion of the connection terminal and/or the one end portion of the wire are disposed in the wire press-fitting portion receiving hole (formed in the inner housing) in closely-contacted relation to the inner peripheral surface of this hole. Thus, the connection terminals can be easily received within the inner housing, and despite this the thermoplastic synthetic resin can be prevented from flowing to reach the electrical contact portions of the connection terminals. In view of enhanced handleability and a reduced number of the component parts, preferably, the opening/closing member is formed integrally with the vertical wall via a hinge as in one preferred embodiment of a waterproof connector of the invention described later. However, the opening/closing member can be separate from the vertical wall.

In the waterproof connector of the present invention, when forming the waterproof mechanism by the use of the thermoplastic synthetic resin such as a hot-melt adhesive, the thermoplastic synthetic resin is prevented from flowing to reach the electrical contact portions of the connection terminals, and therefore the rearwardly-projecting length of the waterproof connector can be made small.

DETAILED DESCRIPTION OF THE PREFERRED EMBODIMENTS

Figure 1:
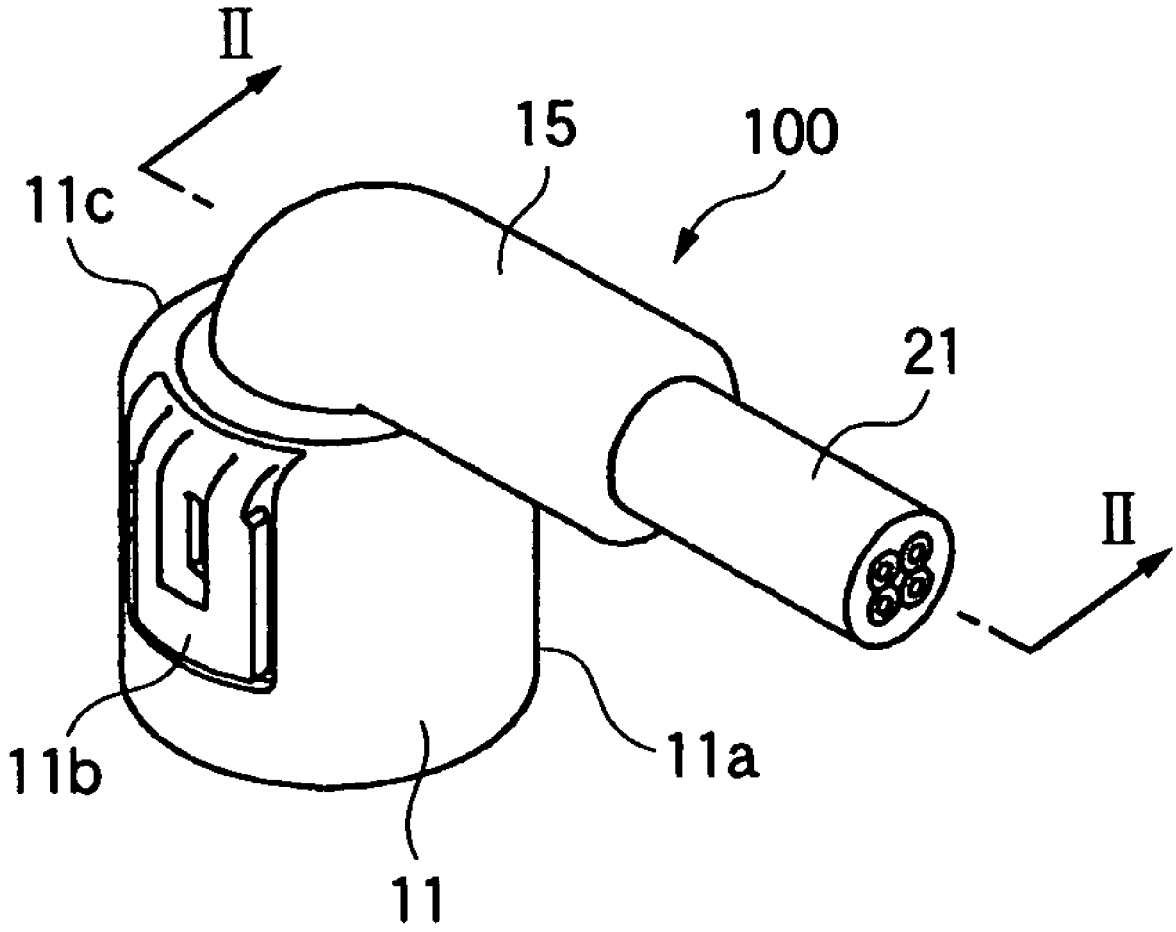
FIG. 1 is a perspective view of a waterproof connector of the present invention.

A preferred embodiment of the present invention will now be described in detail with reference to the drawings. Here, the invention is applied to a waterproof connector for electrical connection to a CCD camera contained in a side mirror of a vehicle or the like, and one preferred embodiment of the waterproof connector of the invention will be described.

As shown in FIGS. 1 to 8, the waterproof connector 100 of the invention receives female connection terminals 17 fixedly secured to one end portions of wires (of a cable) 21, and is fitted to the mating connector 150 to be electrically connected thereto. This waterproof connector 100 comprises the outer housing 11, the inner housing 13 which is provided within the outer housing 11, and holds the connection terminals 17, and a waterproof mechanism 15 which is made of a thermoplastic synthetic resin, and forms a liquid-tight seal between the wires 21, the outer housing 11 and the inner housing 13. The waterproof mechanism 15 is formed by a cured hot-melt adhesive.

The inner housing 13 includes a body portion 13*a* having contact portion insertion holes 13*e* for respectively receiving electrical contact portions 17*a* of connection terminals 17 which can be electrically connected respectively to mating male connection terminals 51 of the mating connector 150, and an opening/closing receiving portion 13*b* having wire press-fitting portion receiving holes 13*r* for respectively receiving wire press-fitting portions 17*b* of the connection terminals 17 press-fastened respectively to the one end portions of the wires 21. The wire press-fitting portion receiving holes 13*r* are so formed that the opening/closing receiving portion 13*b* can be held in intimate contact with at least one of an outer peripheral surface of the wire press-fitting portion 17*b* of each connection terminal 17 and an outer peripheral surface of that portion of the associated wire 21 disposed adjacent to this wire press-fitting portion 17*b*.

The opening/closing receiving portion 13*b* includes a vertical wall 13*d* which is formed on the body portion 13*a*, and extends upwardly therefrom in a direction of extending of the contact portion insertion holes 13*e*. Part (More specifically, that portion defined by a semi-circular groove 13*n*) of each of the wire press-fitting portion receiving holes 13*r* is formed in this vertical wall 13*d*. The opening/closing receiving portion 13*b* further includes a pair of opening/closing members 13*c* and 13*c* (The number of the opening/closing members 13*c* may be one) each of which has other part (More specifically, that portion defined by a semi-circular groove 13*m*) of each of the wire press-fitting portion receiving holes 13*r* formed therein. Each of the opening/ closing members 13*c* and 13*c* can be engaged with the vertical wall 13*d* so as to form the wire press-fitting portion receiving holes 13*r* between the opening/closing member 13*c* and the vertical wall 13*d*. The vertical wall 13*d* and each opening/closing member 13*c* hold at least one of the outer peripheral surfaces of the wire press-fitting portions 17*b* of the corresponding connection terminals 17 and the outer peripheral surfaces of those portions of the associated wires 21, disposed adjacent respectively to these wire press-fitting portions 17*b*, therebetween.

Details of the waterproof connector 100 of this construction will be described below.

Figure 2:
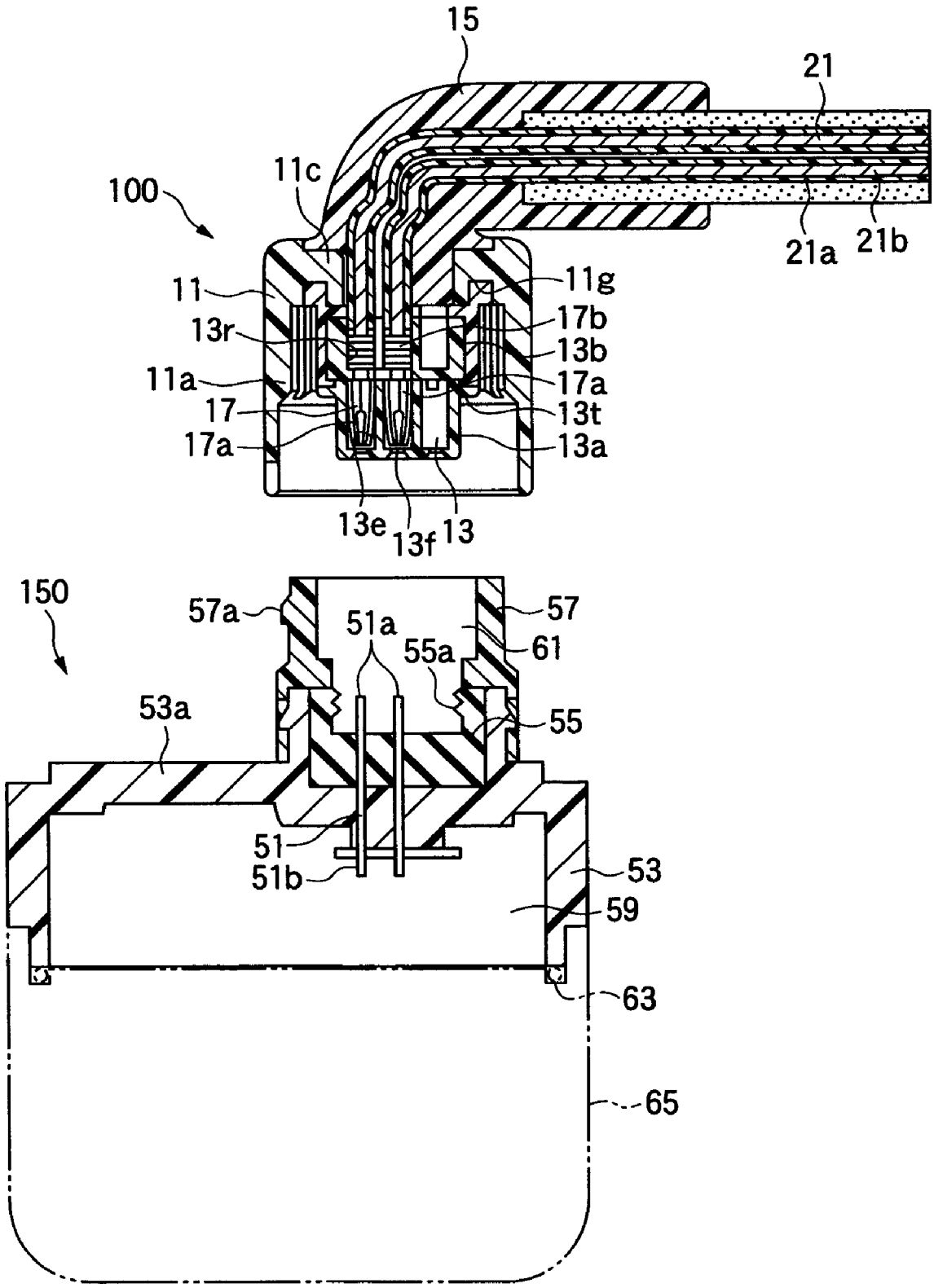
FIG. 2 is a vertical cross-sectional view taken along the line II—II of FIG. 1, showing the waterproof connector and a mating connector.
Figure 3:
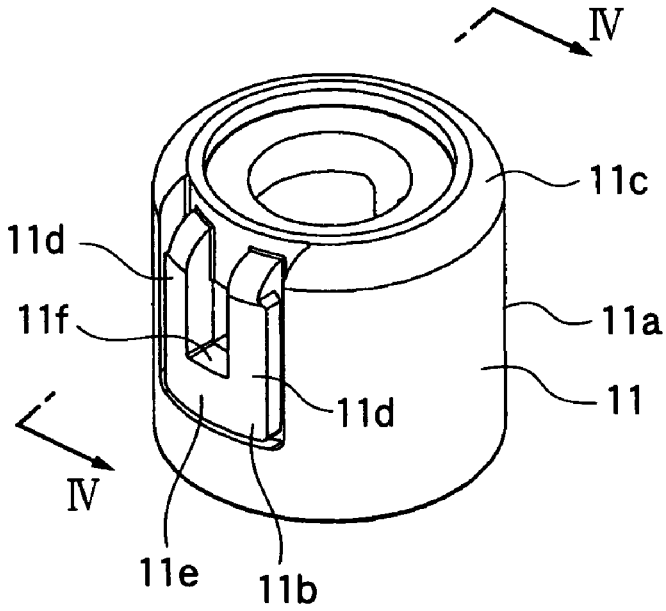
FIG. 3 is a perspective view of an outer housing in FIG. 1.
Figure 4:
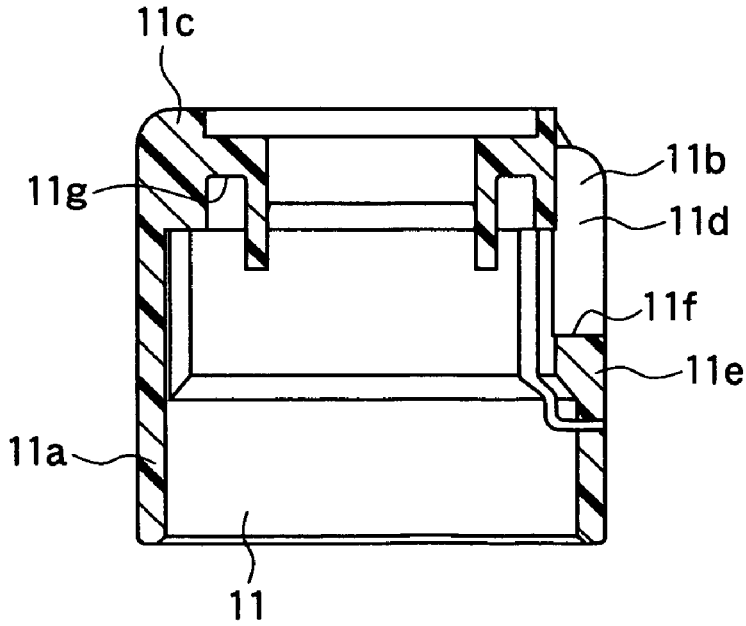
FIG. 4 is a vertical cross-sectional view taken along the line IV—IV of FIG. 3.

As shown in FIGS. 1 and 2, the waterproof connector 100 of the invention is a female-type connector which can be fitted on the mating connector 150 of the male type to be electrically connected thereto.

Figure 5:
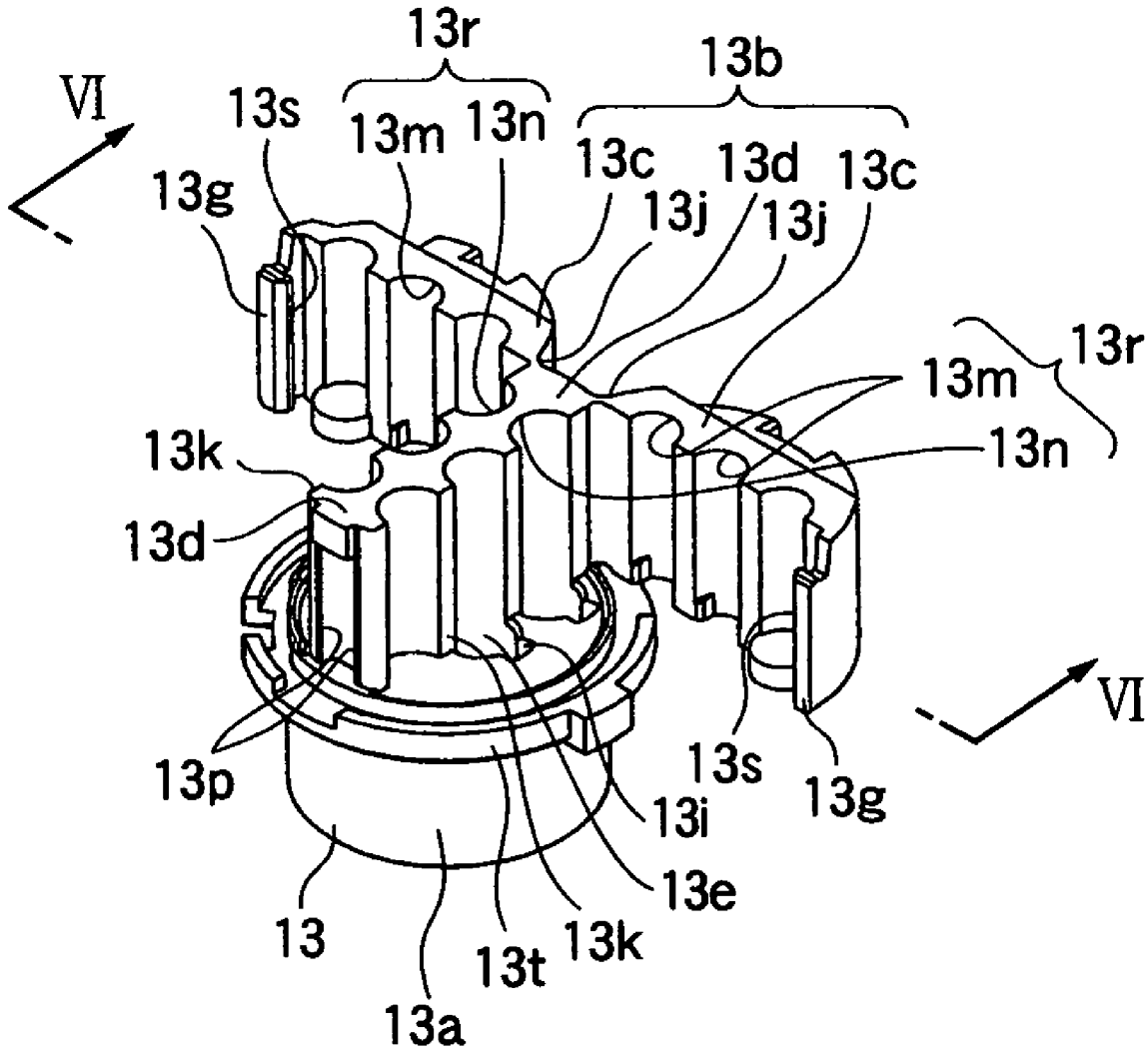
FIG. 5 is a perspective view of an inner housing in FIG. 2.
Figure 6:
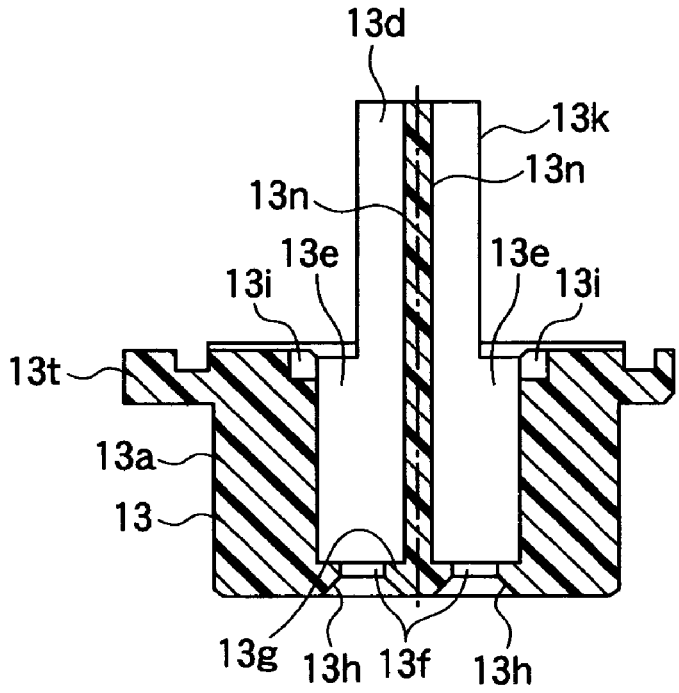
FIG. 6 is a vertical cross-sectional view taken along the line VI—VI of FIG. 5.

As shown in FIGS. 1 to 4, the outer housing 11 is a generally hollow cylindrical member made of a synthetic resin. An elastic engagement arm 11*b* is formed on an outer peripheral wall 11*a* of the outer housing 11. The engagement arm 11*b* includes a pair of parallel arm portions 11*d* which are integrally connected at their one ends to a rear end portion 11*c* of the outer housing 11, and extend forwardly along the axis of the outer housing 11, and an interconnecting portion 11*e* interconnecting front ends of the two arm portions 11*d*. An engagement portion 57*a* on the mating connector 150 can be retainingly engaged with an end surface 11*f* of the interconnecting portion 11*e*. A ring-like groove 11*g* is formed in an inner surface of the rear end portion 11*c*. The inner housing 13, shown in FIGS. 5 and 6, is molded of a synthetic resin similar to the synthetic resin forming the outer housing 11.

The body potion 13*a* of the inner housing 13 has a generally cylindrical shape, and a flange 13*t* is formed on this body portion 13*a*. The plurality of (four in the embodiment of FIG. 5) contact portion insertion holes 13*e* are formed in the body portion 13*a*, and are arranged at predetermined intervals in parallel relation to one another. The contact portion insertion holes 13*e* are provided for respectively receiving the electrical contact portions 17*a* of the connection terminals 17 therein, and the electrical contact portions 17*a* are disposed in these contact portion insertion holes 13*e*, respectively.

A square hole 13*i* with a closed bottom is formed at a rear end of each contact portion insertion hole 13*e*, and is continuous with the contact portion insertion hole 13*e*. A front wall 13*g* is formed at a front end of the contact portion insertion hole 13*e*, and a terminal insertion hole 13*f* is formed through the front wall 13*g* in coaxial relation to the contact portion insertion hole 13*e*. A terminal inserting-side peripheral edge (that is, a front-side peripheral edge) of each terminal insertion hole 13*f* is chamfered as at 13*h* so that the mating male terminal 51 (see FIG. 2) can be easily inserted into the terminal insertion hole 13*f*.

The opening/closing receiving portion 13*b* includes the vertical wall 13*d* extending upwardly from the body portion 13*a* in the axial direction, and the pair of opening/closing members 13*c* and 13 openably/closably connected to one end of the vertical wall 13*d* by respective hinges 13*j* and 13*j*. The cross-sectionally semi-circular grooves 13*n*, each defining part of a respective one of the wire press-fitting portion receiving holes 13*r*, are formed in opposite sides (side surfaces) 13*k* of the vertical wall 13*d*, and extend continuously from the respective contact portion insertion holes 13*e* in the direction of extending of the contact portion insertion holes 13*e*. A groove is formed in that end surface of the vertical wall 13*d* remote from the hinges 13*j*, and is disposed in a central portion of this surface in the circumferential direction, and extends in the axial direction. Elongate projections 13*p* are formed respectively at opposite sides of this groove (that is, formed respectively at axially-extending corner portions of the vertical wall 13*d*). The elongate projections 13*p* serve as engagement portions, and can be engaged respectively with retaining portions 13*q* (formed respectively on the opening/closing members 13*c*) to hold the opening/closing members 13 in their closed condition.

Each opening/closing member 13*c* has a generally semi-circular cross-section, and is connected to the one end of the vertical wall 13*d* by the hinge 13*j*, and the cross-sectionally semi-circular grooves 13*m* (corresponding respectively to the associated semi-circular grooves 13*n*), each defining the other part of a respectively one of the wire press-fitting portion receiving holes 13*r*, are formed in a flat surface of the opening/closing member 13. When each opening/closing member 13 is pivotally moved about the hinge 13*j* into the closed position, the flat surface of the opening/closing member 13*c* is brought into abutting engagement with the side surface 13*k* of the vertical wall 13*d*, so that the semi-circular grooves 13*n* in the vertical wall 13*d* cooperate respectively with the semi-circular grooves 13*m* in the opening/closing member 13*c* to form the wire press-fitting portion receiving holes 13*r* of a circular cross-section. The inner diameter of the wire press-fitting portion receiving hole 13*r* is equal to or slightly smaller than the outer diameter of wire press-fitting portion 17*b* of the connection terminal 17 and the outer diameter of the wire 21. Therefore, when the wire press-fitting portion 17*b* is inserted into the wire press-fitting portion receiving hole 13*r*, the outer peripheral surface of the wire press-fitting portion 17*b* and the outer peripheral surface of that portion of the associated wire 21, disposed adjacent to this wire press-fitting portion 17*b*, are held in close contact with the inner peripheral surface of the opening/closing receiving portion 13*b* (which defines the wire press-fitting portion receiving holes 13*r*) (that is, held in close contact with the surfaces of the corresponding semi-circular grooves 13*n* and 13*m*). Each wire press-fitting portion receiving hole 13*r* can be so formed that the outer peripheral surface of the wire press-fitting portion 17*b* or the outer peripheral surface of that portion of the associated wire 21, disposed adjacent to this wire press-fitting portion 17*b*, can be held in close contact with the inner peripheral surface of the opening/closing receiving portion 13*b* which defines the wire press-fitting portion receiving holes 13*r*.

The retaining portion 13*q* is formed at the distal end of each opening/closing member 13*c* remote from the hinge 13*j*. The retaining portion 13*q* includes an arm portion extending from the distal end of the opening/closing member 13*c* (remote from the hinge 13*j*) in the circumferential direction, and a projection portion 13*s* formed on and projecting radially inwardly from a distal end of this arm portion. The projection portion 13*s* of the retaining portion 13*q* is engaged with the elongate projection 13*p* formed on the vertical wall 13*d*, thereby holding the opening/closing member 13*c* in the closed condition.

Figure 7:
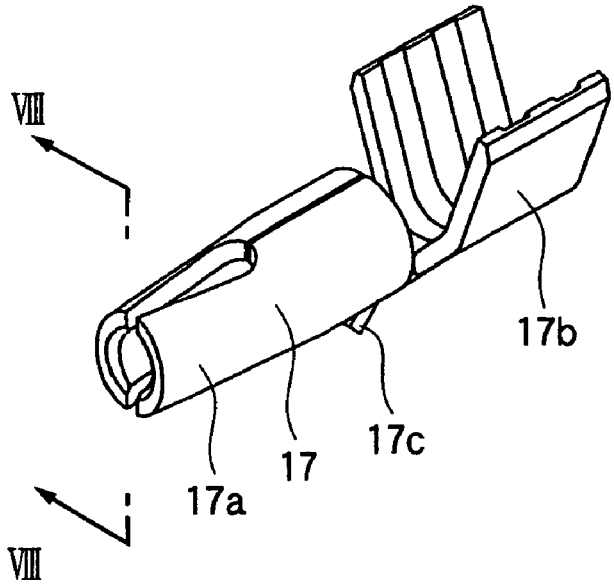
FIG. 7 is a perspective view of a connection terminal in FIG. 2.
Figure 8:
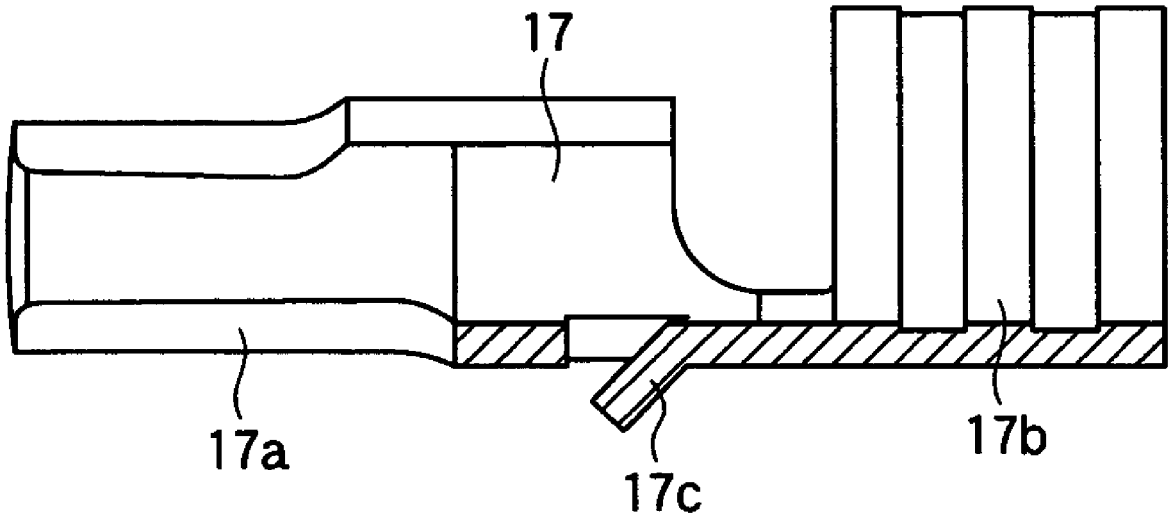
FIG. 8 is a vertical cross-sectional view taken along the line VIII—VIII of FIG. 7.

As shown in FIGS. 7 and 8, the connection terminal 17 is formed by pressing a metal sheet with a thickness, for example, of about 0.2 mm into the predetermined shape. A plating treatment, such as copper undercoat plating or reflow tinning, is applied to the surface of the connection terminal if necessary. The connection terminal 17 includes the electrical contact portion 17*a* for electrical connection to the mating connection terminal 51, and the wire press-fitting portion 17*b* for being press-fastened to a conductor 21*b* of the wire 21 covered with a sheath 21*a*. The wire press-fitting portion 17*b* is formed into a generally U-shape, and the conductor 21*b* is placed on this U-shaped wire press-fitting portion 17*b*, and then the wire press-fitting portion 17*b* is press-deformed into a generally cross-sectionally circular shape to be fastened to the conductor 21*b*, and therefore is electrically connected to the conductor 21*b* (see FIG. 2). A portion of the connector terminal 17 is stamped out and raised to form a lance portion 17*c*.

For forming the waterproof mechanism 15, first, the outer housing 11 and the inner housing 13 are introduced into a mold (not shown), and are held respectively in predetermined positions within the mold, and then a hot-melt adhesive is poured into the interior of the mold, and is filled in gaps between the outer housing 11, the inner housing 13 and the wires (cable) 21, and is cured to form the waterproof mechanism 15 as shown in FIGS. 1 and 2. The outer housing 11, the inner housing 13 and the wires 21 are integrally connected together by the cured hot-melt adhesive. In the embodiment shown in FIG. 2, in order to reduce the length of projecting of the cable (comprising the wires 21) from the rear side of the outer housing 11 in the axial direction, the cable (comprising the wires 21) is bent into a generally L-shape, and the hot-melt adhesive is molded on this L-shaped portion of the cable.

Next, the procedure of assembling the waterproof connector 100 will be described. As shown in FIG. 2, the sheath 21*a* is removed from the end portion of each wire 21 over a predetermined length to expose the conductor 21*b*, and the exposed conductor 21*b* is placed on the wire press-fitting portion 17*b* of the connection terminal 17, and the wire press-fitting portion 17*b* is press-deformed, thereby electrically connecting the wire 21 and the connection terminal 17 together.

The electrical contact portion 17*a* of each connection terminal 17 is inserted into the contact portion insertion hole 13*e* in the inner housing 13, and is received therein. At this time, the lance portion 17*c* of the connection terminal 17 is received in the bottom-closed square hole 13*i*, thereby positioning the connection terminal 17 with respect to a direction of rotation of this connection terminal 17 about its axis (see FIG. 5). At the same time, also, a generally half of the wire press-fitting portion 17*b* of the connection terminal is received in the semi-circular groove 13*n* formed in the vertical wall 13*d*.

Then, each opening/closing member 13*c* is pivotally moved about the hinge 13*j* into the closed position, so that the flat surface of the opening/closing member 13*c* is brought into abutting engagement with the side surface 13*k* of the vertical wall 13*d*, and also the projection portion 13*s* of the retaining portion 13*q* is engaged with the elongate projection 13*p* formed on the vertical wall 13*d*. As a result, each semi-circular groove 13*n* in the vertical wall 13*d* and the corresponding semi-circular groove 13*m* in the opening/closing member 13*c* jointly form the wire press-fitting portion receiving hole 13*r*, so that the wire press-fitting portion 17*b* and the wire 21 are received in the wire press-fitting portion receiving hole 13*r* in closely-contacted relation to the surface of this hole 13*r*.

The inner diameter of the wire press-fitting portion receiving hole 13*r* is equal to or slightly smaller than the outer diameter of the wire press-fitting portion 17*b* and the outer diameter of the wire 21, and therefore the outer peripheral surface of the wire press-fitting portion 17*b* and the outer peripheral surface of that portion of the wire 21, disposed adjacent to this wire press-fitting portion 17*b*, are held in close contact with the inner peripheral surface of the opening/closing receiving portion 13*b* which defines the wire press-fitting portion receiving holes 13*r*. The open side of the bottom-closed square hole 13*i*, having the lance portion 17*c* received therein, is closed by the end surface of the opening/closing member 13*c*, and therefore the connection terminal 17 is prevented from being withdrawn rearwardly from the inner housing 13, so that the connection terminal 17 is positively held within the inner housing 13.

Then, the outer housing 11 and the inner housing 13, having the connection terminals 17 inserted therein, are held respectively in the predetermined positions within the mold (not shown), and in this condition the hot-melt adhesive is supplied into the mold from the rear side of the outer housing 11.

As a result, the hot-melt adhesive is filled in all of the gaps disposed rearwardly of the flange 13*t* of the inner housing 13 provided within the outer housing 11, and also covers part of the cable (comprising the wires 21). The hot-melt adhesive is cured to form the waterproof mechanism 15 which integrally connects the outer housing 11, the inner housing 13 and the cable (comprising the wires 21) together. Namely, the waterproof mechanism 15 is extended into the interior of the outer housing 11, and covers the outer peripheries of the opening/closing members 13*c*, and fixes the inner housing 13.

As shown in FIG. 2, the mating connector 150 is, for example, the male connector formed integrally with a camera casing for receiving a CCD camera unit (not shown). This male connector 150 comprises a casing half portion 53, a packing 53, and a packing holder 57. The casing half portion 53 is divided by a generally rectangular plate-like partition wall 53*a* (in which the mating connection terminals 51 are integrally molded) into an electrical parts chamber 59 and a packing chamber 61.

The packing 55, having annular lips 55*a* formed on an inner peripheral surface thereof, is mounted within the packing chamber 61, and is supported by the packing holder 57. The packing 55 forms a seal between the electrical parts chamber 59 and the packing chamber 61. One end portions 51*a* of the mating connection terminals 51 project from the packing 55. The CCD camera unit (not shown), electrically connected to the other ends of the mating connection terminals 51, is received within the electrical parts chamber 59. A lid 65 is fastened by screws to the casing half portion 53 through a sealing rubber member 63.

The packing holder 57 of the mating connector 150 is fitted into the outer housing 11 of the waterproof connector 100, and the one end portions 51*a* of the mating connection terminals 51 are inserted respectively into the electrical contact portions 17*a* of the connection terminals 17, thereby electrically connecting the mating connection terminals 51 respectively to the connection terminals 17. At this time, the annular lips 55*a* of the packing 55 are fitted on the outer peripheral surface of the inner housing 13, and are held in intimate contact therewith.

In the waterproof connector 100 of the above construction, at least one of the wire press-fitting portion 17*b* of each connection terminal 17 and that portion of the associated wire 21, disposed adjacent to this wire press-fitting portion 17*b*, is received in the corresponding wire press-fitting portion receiving hole 13*r*, with the outer peripheral surface thereof held in intimate contact with the opening/closing receiving portion 13*b*. Therefore, the wire press-fitting portion 17*b* of the connection terminal 17*b* and/or the one end portion of the wire 21 are disposed in the wire press-fitting portion receiving hole 13*r* (formed in the inner housing 13) in closely-contacted relation to the inner peripheral surface of this hole 13*r*. In this condition, the waterproof mechanism 15 is formed, and therefore when the hot-melt adhesive is supplied from the rear side of the connector so as to form a liquid-tight seal between the wires 21, the outer housing 11 and the inner housing 13, the hot-melt adhesive will not flow to reach the electrical contact portions 17*a* of the connection terminals 17. Therefore, the hot-melt adhesive can be supplied to all of the important portions within the waterproof connector 100, and therefore this construction can provide a sufficient strength to prevent the separation of the waterproof mechanism (the cured hot-melt adhesive) even upon application of a stress on the wires 21. Therefore, the waterproof connector 100 can be formed into a compact size, and particularly the rearwardly-projecting length of the outer housing 11 can be reduced. Therefore, the waterproof connector 100 is suitably used as a waterproof connector for connection, for example, to the CCD camera contained in a side mirror of a vehicle.

In the waterproof connector 100 of the above construction, after the electrical contact portion 17*a* of each connection terminal 17 is inserted into the contact portion insertion hole 13*e* in the body portion 13*a* of the inner housing 13, each opening/closing member 13*c* of the opening/closing receiving portion 13*b* of the inner housing 13 is closed, and is engaged with the vertical wall 13*d*, thereby forming the wire press-fitting portion receiving holes 13*r*. At this time, at least one of the wire press-fitting portion 17*b* of each connection terminal 17 and that portion of the associated wire 21, disposed adjacent to this wire press-fitting portion 17*b*, is received in the corresponding wire press-fitting portion receiving hole 13*r*, with the outer peripheral surface thereof held between the vertical wall 13*d* and the opening/closing member 13*c*. Therefore, the wire press-fitting portion 17*b* of the connection terminal 17*b* and/or the one end portion of the wire 21 are disposed in the wire press-fitting portion receiving hole 13*r* (formed in the inner housing 13) in closely-contacted relation to the inner peripheral surface of this hole 13*r*. Thus, the connection terminals 17 can be easily received within the inner housing 13, and despite this the hot-melt adhesive can be prevented from flowing to reach the electrical contact portions 17*a* of the connection terminals 17.

Although the waterproof connector 100 is suited for use as a waterproof connector for connection, for example, to the CCD camera contained in a side mirror of a vehicle, the invention is not limited to such application, but can be applied to any other suitable equipment in the case where it is difficult to obtain a relative large space at the rear side of the waterproof connector.

The present invention is not limited to the above embodiment, and suitable modifications, improvements and so on can be made. The material, shape, dimensions, numerical values, form, number, disposition, etc., of each of the constituent elements of the above embodiment are arbitrary, and are not limited in so far as the invention can be achieved.

What is claimed is:

1. A waterproof connector be fitted to a mating connector to be electrically connected thereto comprising:

an outer housing;

an inner housing, provided within said outer housing, holding a connection terminal connected to an end of wire, said inner housing including:

a body portion having contact portion insertion holes accommodating respectively electrical contact portions of said connection terminals electrically connected respectively to connection terminals of said mating connector; and a receiving portion having wire press-fitting portion receiving holes receiving respectively wire press-fitting portions of said connection terminals which are fixed respectively to the end of said wire, said wire press-fitting portion receiving holes being formed in said receiving portion in such a manner that said receiving portion is held in securely contact with at least one of (1) an outer peripheral surface of said wire press-fitting portion of each connection terminal and (2) an outer peripheral surface of the wire, around an entire periphery thereof, wherein said receiving portion includes:

a vertical wall formed on said body portion and extending upwardly therefrom in a direction of extending of said contact portion insertion holes, part of each of said wire press-fitting portion receiving holes being formed in said vertical wall; and opening/closing member in which other part of each of said wire press-fitting portion receiving holes is formed, said opening/closing member being engaged with said vertical wall to form said wire press-fitting portion receiving holes between said opening/closing member and said vertical wall; and at least one of the outer peripheral surface of said wire press-fitting portion of each connection terminal and the outer peripheral surface of the associated wire is held between said vertical wall and said opening/closing member.

2. A waterproof connector according to claim 1, further comprising:

a waterproof mechanism made of a thermoplastic synthetic resin and forming a liquid-tight seal among said wires, said outer housing and said inner housing.

* * * * *